United States Patent [19]

Mitchell

[11] 4,003,171

[45] Jan. 18, 1977

[54] HYDROSTATIC WATER DISCHARGE VALVE FOR WINDOW FRAME SILLS

[75] Inventor: Henry W. Mitchell, Miami, Fla.

[73] Assignee: Crossley Window Co., Inc., Miami, Fla.

[22] Filed: July 3, 1975

[21] Appl. No.: 592,943

[52] U.S. Cl. ..... 52/209; 49/408; 49/476

[51] Int. Cl.[2] ..... E06B 7/14

[58] Field of Search ..... 52/209; 49/408, 471, 49/476

[56] References Cited

UNITED STATES PATENTS

| | | | |
|---|---|---|---|
| 1,291,511 | 1/1919 | Hester | 52/209 X |
| 1,451,021 | 4/1923 | Hanson | 52/209 X |
| 2,787,034 | 4/1957 | Hauck | 52/209 |
| 3,314,201 | 4/1967 | Riegelman | 52/209 |
| 3,466,819 | 9/1969 | Giger | 52/209 X |
| 3,503,169 | 3/1970 | Johnson et al. | 52/209 |
| 3,845,599 | 11/1974 | Jolly | 52/209 |

*Primary Examiner*—J. Karl Bell
*Attorney, Agent, or Firm*—Ernest H. Schmidt

[57] ABSTRACT

The extruded metal sill assembly of a window frame is partitioned into longitudinally-extending inner and outer chambers by a vertical dividing wall. Water draining from the inside of the window and through a weep opening in an inside top wall portion of the sill collects within the inside chamber for drainage to the outside through valved openings in the dividing wall and a discharge opening in a lower wall portion of the outer sill chamber. The valved openings are controlled for water discharge by means of a flap valve swingably mounted at the outside of the dividing wall between the two chambers, the flap valve carrying a horizontal actuating vane extending into the inner chamber below the weep opening and being adapted for activation by the weight of water draining thereupon through the sill weep opening.

5 Claims, 4 Drawing Figures

HYDROSTATIC WATER DISCHARGE VALVE FOR WINDOW FRAME SILLS

This invention relates to extruded metal window frames, and is directed particularly to improvements in the method and means of discharging condensate water collecting in the lower sill section of such window frames.

Heretofore, in the manufacture of the sills of extruded metal window frames, various devices have been utilized to discharge to the outside of a building, condensate and other water draining to the inside of the sill assembly. Most common among such expedients utilized in the drainage of sill water has been the use of narrow, elongated discharge orafices or weep slots at lower outside portions of the sill, which relied on the surface tension of residual water to prevent the ingress or "percolation" of water under wind-driven rain conditions; and weep holes of substantially greater width backed by porous plastic baffle devices, which allowed water to drain outwardly to be discharged, while at the same time restricting the inflow of windy air and rain. Such window sill water discharge devices heretofore devised, however, have been found to be deficient in various respects, particularly in that while they performed satisfactorily under normal static air pressure and water head conditions, they are subject to erratic operation resulting frequently in the "percolation" of water back into lower portions of the sill at the inside of the window during severe outside weather conditions, such as during rainstorms, particularly when accompanied by gusty, wind-driven rain.

It is, accordingly, the principal object of this invention to provide a novel and improved water discharge valve for extruded metal window frame sills that obviates the limitations and deficiencies of water drainage devices heretofore devised.

A more particular object of the invention is to provide a water discharge valve of the character described wherein the lower section of the window sill is divided into two longitudinally-extending chambers, the inner chamber of which is utilized as a water collection chamber and the outer chamber of which is utilized as an air balance chamber, and wherein a water outflow opening communicating between a lower portion of the water collection chamber and the outer chamber is controlled for water discharge by means of a swingably mounted flap valve at the outside of the dividing wall between the two chambers and carrying a horizontal actuating vane extending into the inner chamber and adapted to be activated by the weight of water at the inside of the sill draining through a cooperatively located weep opening into the water collection chamber, whereby the force of sill drainage water acting upon the vane will serve to break the valve seal created by air pressure within the air balance chamber and water surface tension at the flap valve, to permit the valve to open and function as a controlled water gate allowing for the discharge of water to the outside through weep openings in a lower wall portion of the outer chamber. Upon cessation of water outflow, the outer surface of the flap valve will be acted upon by air pressure generated by outdoor wind to securely seat the flap valve against its associated valve openings to prevent the reverse flow of air and/or water through to the inside of the sill, hereinabove referred to as "percolation".

Another object is to provide a hydrostatic discharge valve of the above nature which will be simple in construction, economical to manufacture, and dependable and durable in operation.

Other objects, features and advantages of the invention will be apparent from the following description when read with reference to the accompanying drawings.

In the drawings, wherein like reference numerals denote corresponding parts throughout the several views.

Figure 1:
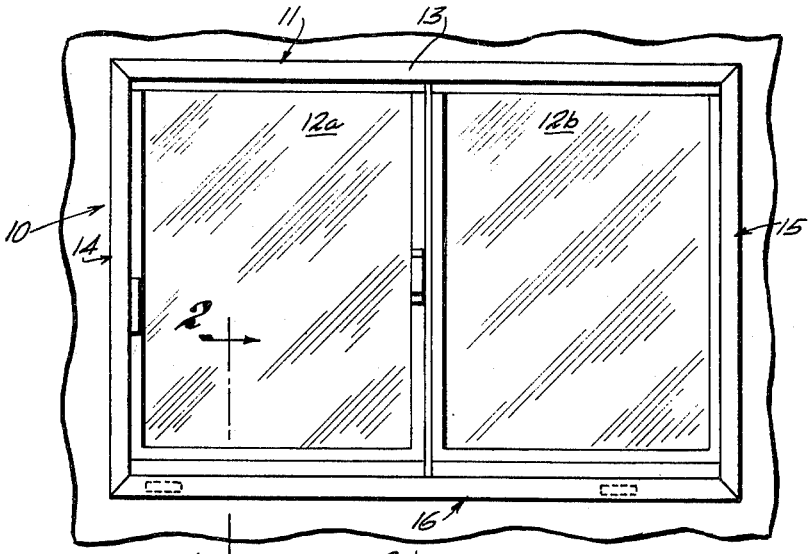
FIG. 1 is an inside elevational view of a typical aluminum window frame having horizontally-sliding window sashes and the sill of which embodies the invention.

Referring now in detail to the drawings, reference numeral 10 in FIG. 1 designates, generally, a sliding sash window assembly having a window frame 11 carrying slidably arranged window sashes 12*a* and 12*b*. The window frame 11, which is preferably fabricated of extruded aluminum parts, comprises a window frame header member 13, window frame jamb or stile members 14, 15, and a window frame sill assembly 16.

Figure 2:
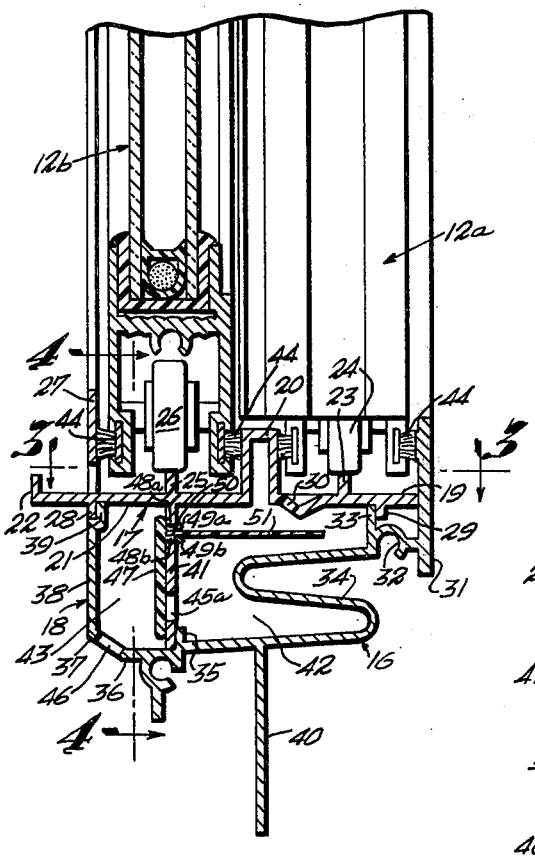
FIG. 2 is a vertical cross-sectional view taken along the line 2—2 of FIG. 1 in the direction of the arrows, and illustrating details of the hydrostatic discharge valve.
Figure 3:
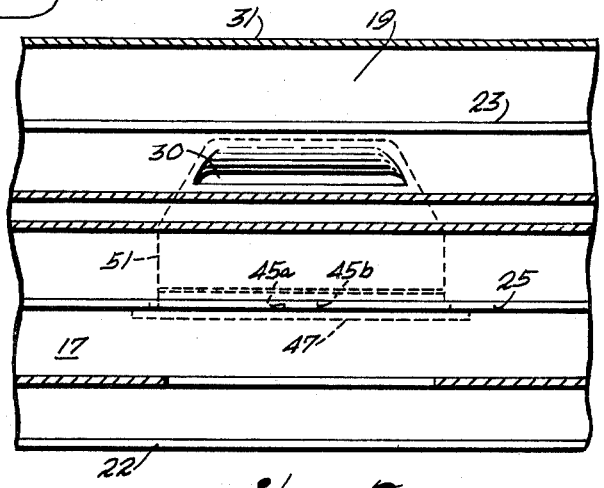
FIG. 3 is a transverse cross-sectional view taken along the line 3—3 in the direction of the arrows and illustrating details of one of the sill water drainage or weep openings.

The window frame sill assembly 16, which embodies the present invention as is hereinafter described, comprises interfitting upper and lower sill members 17 and 18, respectively. The upper sill member 17, as best illustrated in FIGS. 2 and 3, is integrally formed with an inner horizontal base portion 19, the inner end of which merges with an upstanding, inverted, rectangular U-shaped portion 20 the outer end of which, in turn, merges with an outer horizontal base portion 21 lying in the same plane as said inner horizontal base portion and terminating, at the outside of the window, in an upturned lip portion 22.

The inner horizontal base portion 19 is formed with a coextensive upstanding rail 23 serving as a track for roller wheels 24 (only one illustrated) of sliding inner sash assembly 12*a*; and the outer horizontal base portion 21 is similarly formed with an upstanding track rail 25 serving as a track for roller wheels 26 (only one illustrated), of the sliding outer sash assembly 12*b*. The outer base portion 21 is also integrally formed along its length, near the outer end thereof, with an upstanding outer wall portion 27 of approximately the same height as that of the inverted U-shaped portion 20.

The outer horizontal base portion 21 is also formed along its underside and in register with the upstanding outer wall portion 27, with a comparatively short, downwardly-extending projection 28, for the purpose hereinafter appearing. The inner horizontal base portion 19 is similarly formed along its underside with a short, downwardly-extending projection 29, spaced approximately midway between the inner end and the upstanding rail 23 of said inner horizontal base portion. As best illustrated in FIG. 3, the inner horizontal base portion 19 of the upper sill member 17 is also provided along its length with one or more elongated weep openings 30, along inner marginal portions thereof adjacent the inner wall of the upstanding rectangular U-shaped portion 20.

The lower sill member 18 of the sill assembly 16 comprises an upstanding inner wall portion 31 along the lower inside marginal portion of which is integrally formed an arcuate section 32 merging with the short, upstanding abutment portion 33 and which extends at its lower end into a reversely-bent, downwardly-directed intermediate section 34 merging with short, longitudinally coextensive, upwardly-extending abutment portion 35. The lower end of the intermediate section 34 also merges with a bottom wall portion 36 extending into a comparatively short, upwardly-inclined wall portion 37 which, in turn, merges with an upwardly-extending outer wall portion 38 terminating at its upper end in an inwardly-offset, interlocking portion 39. The underside of the intermediate section 34, about midway along its width, is integrally formed with a downwardly-extending frame opening attachment plate portion 40, serving as an abutment plate for securing the sill of the window frame in place against a window frame opening.

As illustrated in FIG. 2, the upper and lower sill members 17, 18 are so proportioned that when assembled in interfitting relation, the outer edge of the inner horizontal base portion 19 of said upper sill member abuts along the inside wall, about midway along its height, of the inner wall portion 31 of the lower sill member 18; the short upstanding abutment portion 33 of said lower sill member abuts against the inside corner defined by the short, downwardly-extending projection 29 of said inner horizontal base portion; and the inwardly-offset, interlocking portion 39 of said lower sill member interfits with the short, downwardly-extending projection 28 of the outer horizontal base portion 21.

As further illustrated in FIG. 2, the outer horizontal base portion 21 of the upper sill member 17 is provided, integrally formed along its length, with a vertically downwardly-extending partition wall portion 41, in register with the upstanding rail 25 and of such length as to overlap, in substantially sealing engagement, the outer surface of the upwardly-extending portion 35 of the lower sill member 18 upon said sill members being assembled in interfitting relation. The partition wall portion 41 divides the lower sill member 18 of the sill assembly into a longitudinally-extending water chamber 42 at the inside of the frame and a longitudinally-extending air balance chamber 43 at the outside of the frame. As further illustrated in FIG. 2, the opposing, inwardly-directed surfaces of the upstanding outer wall portion 27 of the outer horizontal base portion 21 of the upper sill member 17, and the upstanding inner wall portion 31 of the lower sill member 18, together with the outer wall surfaces of the rectangular U-shaped portion 20 of said upper sill member, serve as abutment slide surfaces for wool pile weatherstripping strips 44 provided along inner and outer lower marginal edge portions of the window sash assemblies **12*a* and 12*b***.

Figure 4:
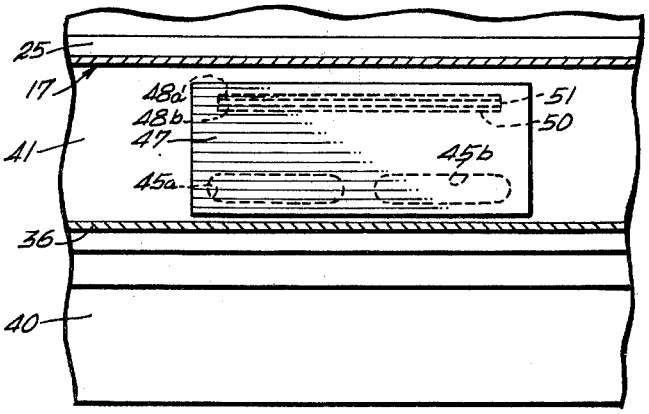
FIG. 4 is a vertical cross-sectional view taken along the line 4—4 of FIG. 2 in the direction of the arrows.

Novel means is provided for discharging condensate water and other water draining into upper surface areas of the upper sill member 17 of the outside of the window through the elongated weep opening 30 in said upper sill member. To this end, as illustrated in FIGS. 2 and 4, the downwardly-extending partition wall 41 of the upper sill member 17 is provided, along lower marginal end portions thereof, with a pair of side-by-side, through openings **45*a*, 45*b*, said openings being substantially in register with a cooperative weep opening 30, for the purpose hereinafter more particularly described. The short, upwardly-inclined wall portion 37 of the lower sill member 18, as illustrated in FIGS. 1 and 2, is provided with elongated water discharge openings 46. It will thus be apparent that under certain operating conditions hereinafter more particularly specified, condensate and other water draining through a weep opening 30 can flow through the associated through openings 45*a*, 45*b* and into the air-balance chamber 43 for discharge to the outside through water discharge openings 46**.

Means is provided to prevent the reverse flow of air and/or water through the water discharge opening 46, partition wall openings **45*a*, 45*b* and weep opening 30 under severe outside weather conditions, such as heavy rainstorms accompanied by wind-driven rain. To this end, a hydrostatic gate valve is provided for sealing off the through openings 45*a*, 45*b* in the partition wall 41 against back-flow, said gate valve comprising a rectangular flap member 47 hinged along an upper end portion thereof so as to be swingable in face-to-face relation against the outside of the partition wall portion 41 of upper sill member 17 in sealing relation with respect to said through openings. The rectangular flap member 47, which is preferably integrally molded of a tough synthetic plastic material, is formed along an upper marginal edge portion with sidewardly outwardly-projecting, opposed pivot portions 48*a*, 48*b*, terminating in mutually outwardly-extending lip portions 49*a*, 49*b*, said pivot portions being receivable through a longitudinally-extending slot 50 provided in the downwardly-extending partition wall 41. The pivot portions 48*a*, 48*b* of the rectangular flap member 47 are freely received within the slot 50 to permit limited pivotal or swinging movement of said flap between sealing and release position with respect to the through openings 45*a*, 45*b***.

A thin sheet plastic hydrovane 51 has a marginal edge portion frictionally received in clamping relation between the opposed pivot portion **48*a*, 48*b* of the flap member 47, so as to move in unison with said flap member, said hydrovane, as illustrated in FIG. 2 being disposed within the water chamber 42 and extending at outer end portions thereof to a position just below the associated weep opening 30 in the upper sill member 17. The weight of the hydrovane 51 is such that, in the quiescent atmospheric state, the water gate system is balanced with the flap member 47 resting lightly in closed relation with respect to the water discharge openings 45*a* and 45*b***.

In operation, water from inside the window frame sill draining through the associated weep opening 30 will fall upon the hydrovane 51, which serves to upset the balance condition of the associated flap member 47, causing it to swing outwardly to permit water accumulating in the water chamber 42 to flow outwardly and be discharged to the outside of the building through the discharge opening 46. In this connection it is to be noted that the force exerted by the weight of water falling upon the hydrovane 51 near the outer end thereof as described above, will be sufficient not only to upset the balance of the water gate or valve system, but also to break the resisting forces of surface tension imposed by any residual water film between the contacting surfaces of the flap member 47 and the partition wall portion 41 of the upper sill member 17. The discharge of water draining from the inside of the window sill to the outside, as described above, will normally continue until all water is discharged, whereupon the flap member 47 will reseat against the through openings 45*a*, 45*b*, to prevent reverse flow of air or water. If, during the drainage process, extreme outside wind and rain conditions should occur, air pressure within the air balance chamber 43 will normally increase with respect to pressure within the water chamber 42, so as to force the flap member 47 shut, thereby preventing the reverse flow of air and/or water through the water chamber 42 and back up through the weep opening 30 in the upper sill member 17. It is also to be understood that the air balance chamber 43 serves as baffle means to moderate or average varying wind pressure forces being exerted under stormy weather conditions at the outside of the window, thereby minimizing the possibility of random changes in wind velocity affecting efficient operation of the flap member 47.

While I have illustrated and described herein only one form in which my invention can conveniently be embodied in practice it is to be understood that this form is presented by way of example only and not in a limiting sense. The invention, in brief, comprises all the modifications and embodiments coming within the scope and spirit of the following claims.

What I claim as new and desire to secure by Letters Patent is:

1. A hydrostatic discharge valve assembly for window frame sills comprising, in combination, an upper longitudinally-extending sill section, a lower longitudinally-extending sill section and inner and outer sill wall sections, said upper, lower, inner and outer sections together defining a coextensive enclosure, a vertical, longitudinally-extending partition wall dividing said enclosure into a longitudinally-extending water chamber between said partition wall and said inner wall section and an air-balance chamber between said partition wall and said outer wall section, a weep opening in said upper sill section for the drainage of condensate water into said water chamber, means controlled by water draining through said weep opening for discharging water collected in said water chamber into said air-balance chamber, and a discharge opening in said lower sill section and communicating with said air-balance chamber for discharging water to the outside of said lower sill section, said water draining controlled water discharging means comprising a water outflow through opening in a lower end portion of said partition wall, a flap member, means for swingably mounting an upper end portion of said flap member against the air-balance chamber side of said partition wall and in vertical alignment with said through opening so that said flap member will normally rest in face-to-face relation against said partition wall for blocking flow through said through opening, and a substantially horizontally disposed actuating vane carried by said flap member along an upper end portion thereof and extending into said water chamber directly below said weep opening, whereby the force of window frame sill drainage water falling through said weep opening and upon said vane serves to break the adhesive force of water film tension between said flap member and said partition wall to permit outward swinging of said flap member for water drainage through said partition wall through opening and said lower sill section drainage opening.

2. A hydrostatic discharge valve assembly for window frame sills as defined in claim 1, wherein said upper, lower, inner and outer sill sections are formed of extruded metal so as to be of uniform cross-sectional shape along their lengths.

3. A hydrostatic discharge valve assembly for window frame sills as defined in claim 2, wherein said upper sill section is integrally extruded and wherein said lower sill section, said inner sill wall section and said outer wall sill section are integrally formed as a single extrusion.

4. A hydrostatic discharge valve assembly for window frame sills as defined in claim 3, wherein said partition wall is integrally extruded with said upper sill section.

5. A hydrostatic discharge valve assembly for window frame sills as defined in claim 2, wherein said outer sill section is formed with a reversely double-bent portion providing a substantially increased heat conductive flow path between upper and lower portions thereof.

* * * * *